US008235760B2

(12) United States Patent
Rechner et al.

(10) Patent No.: US 8,235,760 B2
(45) Date of Patent: Aug. 7, 2012

(54) PADDLE WITH SELECTABLE BLADE ANGLE

(75) Inventors: Susanne Rechner, Weston, CT (US); Larry J. Knust, Easley, SC (US)

(73) Assignee: Confluence Holdings Corp., Easley, SC (US)

( * ) Notice: Subject to any disclaimer, the term of this patent is extended or adjusted under 35 U.S.C. 154(b) by 154 days.

(21) Appl. No.: 12/846,713

(22) Filed: Jul. 29, 2010

(65) Prior Publication Data

US 2012/0028519 A1 Feb. 2, 2012

(51) Int. Cl.
*B63H 16/04* (2006.01)

(52) U.S. Cl. ..... 440/101

(58) Field of Classification Search ..... 440/101
See application file for complete search history.

(56) References Cited

U.S. PATENT DOCUMENTS

| | | | | |
|---|---|---|---|---|
| 1,307,160 | A | 6/1919 | Stokes | |
| 2,882,053 | A * | 4/1959 | Lorthiois | 473/245 |
| 3,144,909 | A | 8/1964 | Hart et al. | |
| 4,365,807 | A | 12/1982 | Melby | |
| 4,605,378 | A | 8/1986 | Hamilton | |
| 4,820,216 | A | 4/1989 | Masters | |
| 4,854,596 | A * | 8/1989 | Carbonetti | 473/551 |
| 5,409,324 | A | 4/1995 | Johnson, Jr. | |
| 5,842,830 | A | 12/1998 | Franznick | |
| 5,935,670 | A | 8/1999 | Downs | |
| 6,022,255 | A | 2/2000 | Lukanovich | |
| 6,086,284 | A | 7/2000 | Callahan | |
| 6,319,442 | B1 | 11/2001 | Downs | |
| 6,328,617 | B1 | 12/2001 | Gunnell | |
| 6,419,601 | B1 | 7/2002 | Kenner | |
| 6,428,225 | B1 | 8/2002 | Nguyen | |
| 6,595,713 | B1 * | 7/2003 | Wilson | 403/7 |
| 6,626,716 | B1 | 9/2003 | Peng | |
| 6,640,864 | B2 | 11/2003 | Downs | |
| 6,686,016 | B2 | 2/2004 | Downs | |
| 6,881,111 | B2 * | 4/2005 | Bridge et al. | 440/101 |

(Continued)

FOREIGN PATENT DOCUMENTS

WO WO0131217 5/2001

OTHER PUBLICATIONS

International Search Report mailed Jan. 2, 2012 from International Application No. PCT/US2011/046011.

*Primary Examiner* — Stephen Avila
(74) *Attorney, Agent, or Firm* — Schwabe, Williamson & Wyatt, P.C.

(57) ABSTRACT

A paddle for use in watersports is provided with shaft halves and blades at the end of each shaft half with a selectable offset angle between the blades. A joint connecting the shaft halves may include an interlocking coupling that maintains the offset angle of the blades, and that may allow a change in the offset angle of the blades. A biasing member may hold the interlocking coupling in the use configuration. The shaft halves may be moved axially apart to change the offset angle of the blades. All mechanisms for switching the interlocking coupling between the use configuration and the selection configuration may be located within the shaft halves. A retaining clip may be coupled between the first and second shaft halves to allow the selection configuration while preventing disassembly of the first and second shaft halves. A disassembly control can be provided independently of the angle selection.

41 Claims, 5 Drawing Sheets

U.S. PATENT DOCUMENTS

| | | | |
|---|---|---|---|
| 7,195,049 | B2 | 3/2007 | Downs et al. |
| 7,204,287 | B2 | 4/2007 | Casaldi |
| 7,367,858 | B2 | 5/2008 | Matuska et al. |
| 2001/0053641 | A1 | 12/2001 | Zwaan et al. |
| 2003/0118771 | A1 | 6/2003 | Downs |
| 2003/0164220 | A1 | 9/2003 | Downs |
| 2004/0023570 | A1 | 2/2004 | Bridge et al. |
| 2004/0151861 | A1 | 8/2004 | Downs |
| 2005/0118378 | A1 | 6/2005 | Downs |
| 2005/0126692 | A1 | 6/2005 | Hajny |
| 2005/0178507 | A1 | 8/2005 | Hajny |
| 2006/0252317 | A1 | 11/2006 | Matuska et al. |
| 2007/0175589 | A1 | 8/2007 | Casaldi |
| 2007/0184729 | A1 | 8/2007 | Kicker |
| 2008/0017323 | A1 | 1/2008 | Peterson |

* cited by examiner

PADDLE WITH SELECTABLE BLADE ANGLE

TECHNICAL FIELD

The present disclosure relates to a paddle, typically for use with a non-motorized watercraft. The paddle has a blade at each of two ends, and the angles of the blades relative to one another may be selected by the user during use. For example, in a boat paddle, such as a double-bladed kayak paddle, the offset angle of the blades is selected for various styles of paddling strokes and/or for left-hand or right-hand dominated paddling. The paddle may also be broken down into two parts for storage and transportation.

U.S. Pat. Nos. 4,820,216 and 6,881,111 show adjustable kayak paddles, each with an external collar or button on the shaft that is operated to adjust the blade angle by relative movement of two portions of the shaft. Also, with the collar or button operated to allow the blade angle to be adjusted, the two portions of the shaft are no longer axially held together and may be separated, intentionally or unintentionally.

SUMMARY

A paddle blade for use in watersports is provided. The paddle blade includes: right and left shaft halves, two blades, each mounted to an end of one of the shaft halves, and an interlocking coupling between the shaft halves. The coupling may be switchable between a use configuration and a selection configuration. In the use configuration, an offset angle of the blades relative to one another is generally fixed, as is generally desired for paddling operations. In the selection configuration, the offset angle of the blades may be selected, typically between about 0-degrees and about 90-degrees, or any range of angles suitable for a particular application of the paddle.

The coupling may include an axially directed biasing member that biases the shaft halves toward one another and maintains the coupling in the use configuration. The coupling may also include a retaining clip for holding the shaft halves together while the offset angle is selected. The coupling may also include a pair of toothed crowns mounted in respective shaft halves, which crowns are mated in the use configuration to maintain the offset angle and separated in the selection configuration to allow selection of a new offset angle. The axially directed biasing member may compress together the toothed crowns while allowing, when the user overcomes the bias, axial movement apart and rotation of the shaft halves for offset angle selection.

The coupling may be contained entirely within hollow portions of the right and left shaft halves, with control for the selective blade offset operated by pulling the halves axially apart. Typically, the shaft will include no external control, such as a collar or button, for offset angle selection, and all mechanisms for switching the coupling to the selection configuration may be located within the shaft halves.

The paddle may include a control, typically separate from the control for selecting the blade offset angle, by operation of which the shaft may be separated into two pieces. Such control is typically operable externally to the shaft, such as by a button mounted through the wall of the shaft.

The paddle of the present disclosure provides easy and intuitive operation for selection of the blade offset angle. The exterior of the shaft may be made with no external locking, selection, or adjustment elements. The only externally visible aspect of the selective-angle coupling may be just a meeting of the two shaft halves at a mating interface. The shaft is typically just a smooth cylinder in its external structure, providing easy elimination of dirt and grime buildup and no knobs, buttons, or collars likely to be damaged. These make the paddle more reliable, durable, and light weight.

DETAILED DESCRIPTION OF THE PREFERRED EMBODIMENTS

Figure 1:
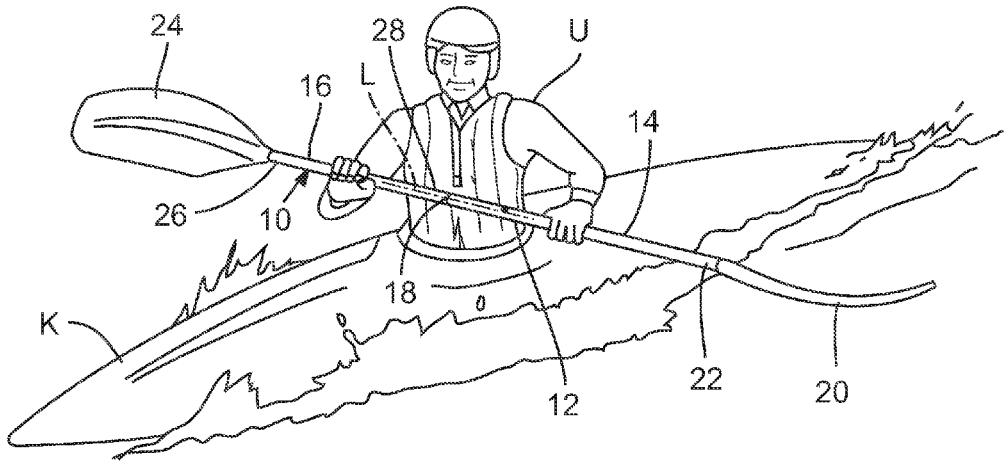
FIG. 1 is a view of a paddle according to the present disclosure in use by a kayaker in a kayak, showing a shaft and blades and a joint between two shaft halves.

The present disclosure relates to a novel paddle for a self-propelled personal watercraft such as a kayak, generally such a paddle having two blades. Referring to the drawings, the present disclosure illustrates a paddle, such as kayak paddle 10. The paddle may be used by a kayaker U in a kayak K, as can best be seen in FIG. 1, or in other suitable forms of watercraft. Paddle 10 includes a shaft 12 with a first shaft half 14 and a second shaft half 16 joined together by a coupling interface, such as joint 18. A first blade 20 is carried by an end 22 of shaft half 14 and a second blade 24 is carried by an end 26 of shaft half 16.

Blades 20, 24 are generally flat, and to the extent they include curved features and/or an overall curve, are the same or similar in shape to one another. The blades therefore can be understood to define an offset angle A, where a generally co-planar position for the blades is 0-degrees, and a right angle, as shown in FIG. 1, is 90-degrees.

Paddle 10 is depicted in the drawings as having a straight shaft. It will be understood that the shaft may be provided with bends or curves or other features to aid in paddling and gripping. Typically the shaft will include at least a mid-portion 28 that is substantially straight and defines a longitudinal axis L.

Figure 2:
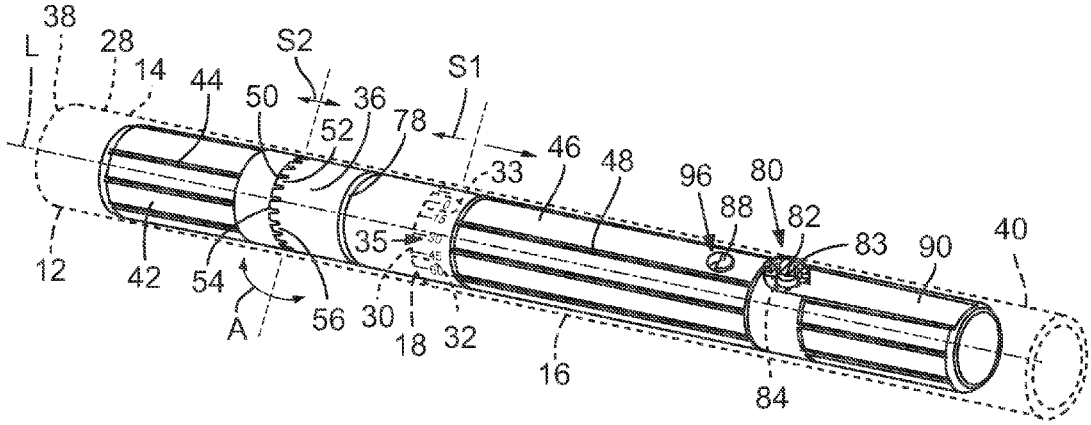
FIG. 2 is a view of an interlocking coupling at the joint of the embodiment of FIG. 1, showing the shaft halves in phantom line and, within the shaft halves, a spring housing and a cylinder mated at toothed crowns, and a receptacle fixed within one shaft half releasably holding the cylinder under control of a button.
Figure 3:
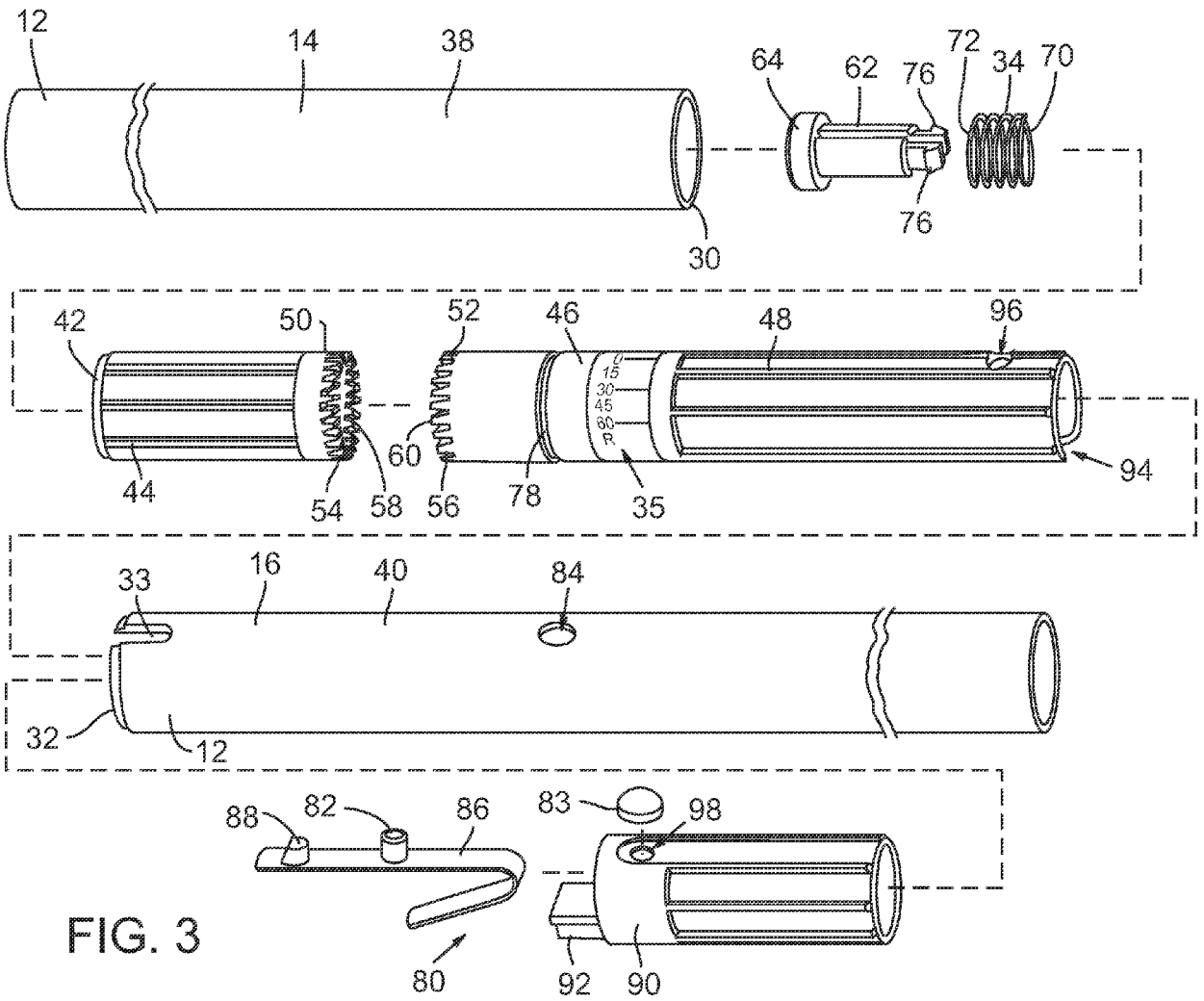
FIG. 3 is an exploded view of the interlocking coupling of FIG. 2, additionally showing a retaining clip and a biasing member, and a disassembly control and receptacle.
Figures 4A, 4B, 11:
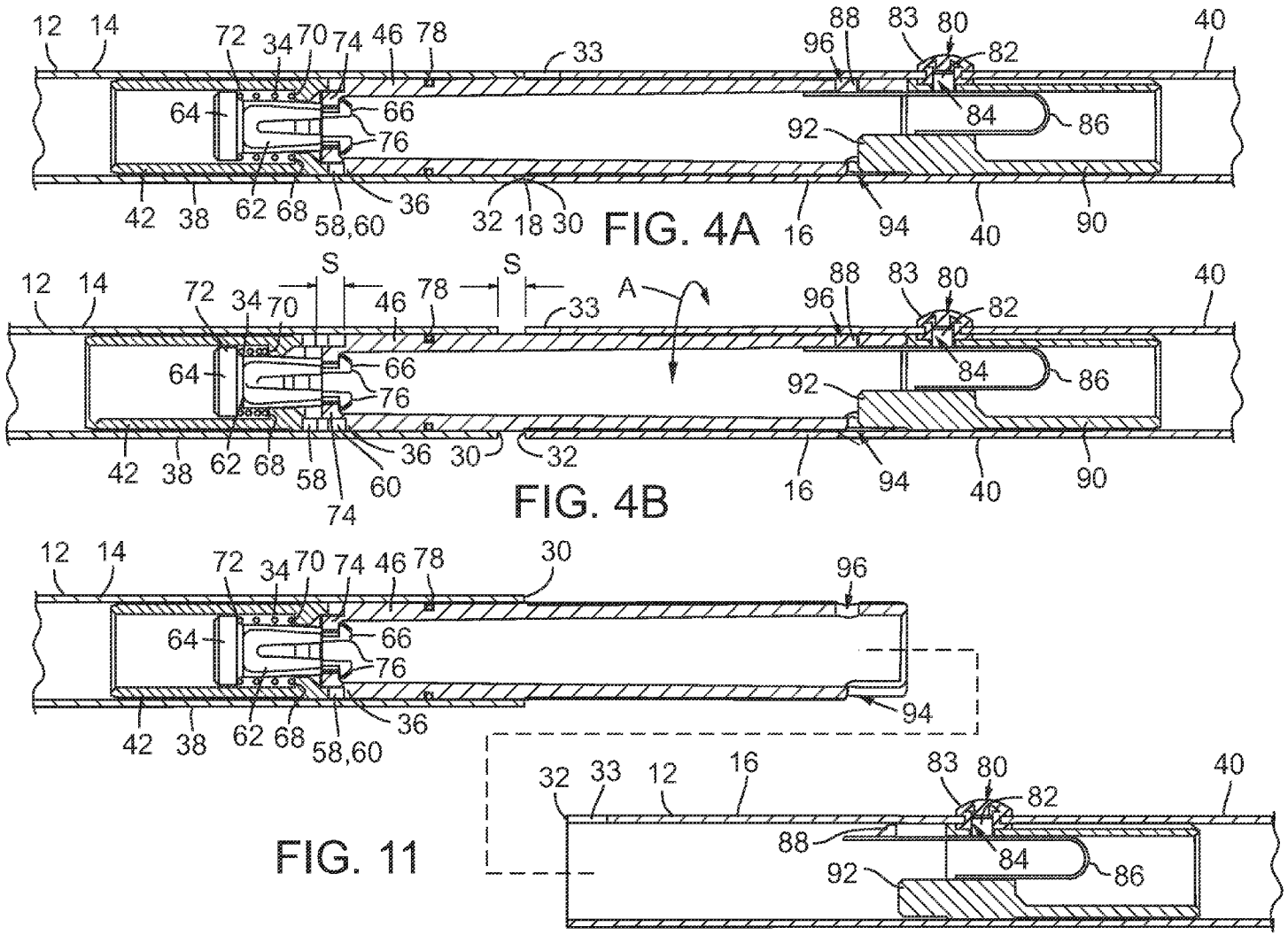
FIGS. 4*a* and 4*b* are cross-sectional views of the interlocking coupling showing the use configuration and selection configuration, respectively
FIG. 11 is a cross-sectional view showing disassembly of the shaft halves.

As shown in FIGS. 2, 4A, and 4*b*, first shaft half 14 may include adjacent joint 18 a first mating surface 30, which typically is a flat annular surface, but may include other features. Second shaft half 16 may provide a second mating surface 32 positioned adjacent first mating surface 30. As will be explained below, second mating surface 32 and first mating surface 30 are typically biased toward one another. They may meet at corresponding flat annular surfaces, at other complementary surfaces, or operate otherwise as desired for a particular application for the paddle. FIGS. 2 and 3 depict an array of indicators, here numerals 0, 15, 30, 45, and 60 in either rotational direction (see FIG. 13 as well), corresponding to the angulation of blades 20 and 24 with respect to each other. A window 33 permits the user to always be able to readily see the angulation setting. The numerals are generally identified at 35. Use of the numerals and the window will be described in more detail below.

First and second shaft halves 14, 16 are typically connected at joint 18, which may include a biasing member, such as compression spring 34 (FIGS. 3-4) operating along longitudinal axis L. Biasing member 34 typically provides a bias urging first and second shaft halves 14, 16 together.

Joint 18 may include an interlocking coupling 36 between first and second shaft halves 14, 16. Interlocking coupling 36 maintains, in a use configuration (FIG. 4*a*), a fixed offset angle for the blades. Interlocking coupling 36 allows, in a selection configuration (FIG. 4*b*), a user to select a change in the offset angle of the blades. Typically biasing member 34 provides a bias that urges separable portions of the interlocking coupling together, thereby holding the interlocking coupling in the use configuration absent a user's pulling the shaft halves axially apart by overcoming the bias.

Shaft halves 14, 16 are operable as shown in FIGS. 4*a* and 4*b* to be moved relative to one another in opposite directions along the longitudinal axis against the bias of biasing member 34. Interlocking coupling 36 is switched to the selection configuration (FIG. 4*b*) when the shaft halves are moved sufficiently far apart along the longitudinal axis to disengage an interlocking mechanism.

Preferably, all mechanisms for switching the interlocking coupling between the use configuration and the selection configuration, as will be further described below, are located within the shaft halves. The user's moving the shaft halves relative to one another in opposite directions along longitudinal axis L against the bias operates the mechanisms within the shaft halves to switch the interlocking coupling to the selection configuration.

Typically each of shaft halves 14, 16 largely comprise, and at least include, a hollow tube 38, 40. Interlocking coupling 36 typically is inserted into and contained within hollow tubes 38, 40.

For example, interlocking coupling 36 may include a spring housing 42 inserted within hollow tube 38 of first shaft half 14. Spring housing 42 may be press-fitted or otherwise installed within hollow tube 38 of shaft half 14, preferably to remain in a fixed position with respect to shaft half 14 for the operations of the paddle described herein. Spring housing 42 may include features, such as ribs 44 to aid in fixing housing 42 in place within hollow tube 38, particularly to prevent rotation of shaft half 14 around longitudinal axis L relative to housing 42.

Interlocking coupling 36 may include a cylinder 46 inserted within hollow tube 40 of second shaft half 16. Cylinder 46 may include features, such as ribs 48, to aid in fixing cylinder 46 in place within hollow tube 40. This generally prevents rotation of shaft half 16 around longitudinal axis L relative to cylinder 46.

Spring housing 42 and cylinder 46 preferably each include an end 50, 52 configured to mate with the other and, when mated, to prevent relative rotation about longitudinal axis L of spring housing 42 and cylinder 46. For example spring housing 42 may be provided with a toothed crown 54 that mates with a toothed crown 56 on cylinder 46, or with any other suitable interlocking mechanism. Each of crowns 54 and 56 typically include teeth 58 and 60, respectively.

Generally, ends 50, 52 are mated to prevent rotation, for example by the toothed crowns' being mated together, in the use configuration as shown in FIGS. 3 and 4*a*. Ends 50, 52 and toothed crowns 54, 56 are separated from one another in the selection configuration as shown in FIG. 4*b*.

Figures 5, 6, 7, 8, 9, 10:
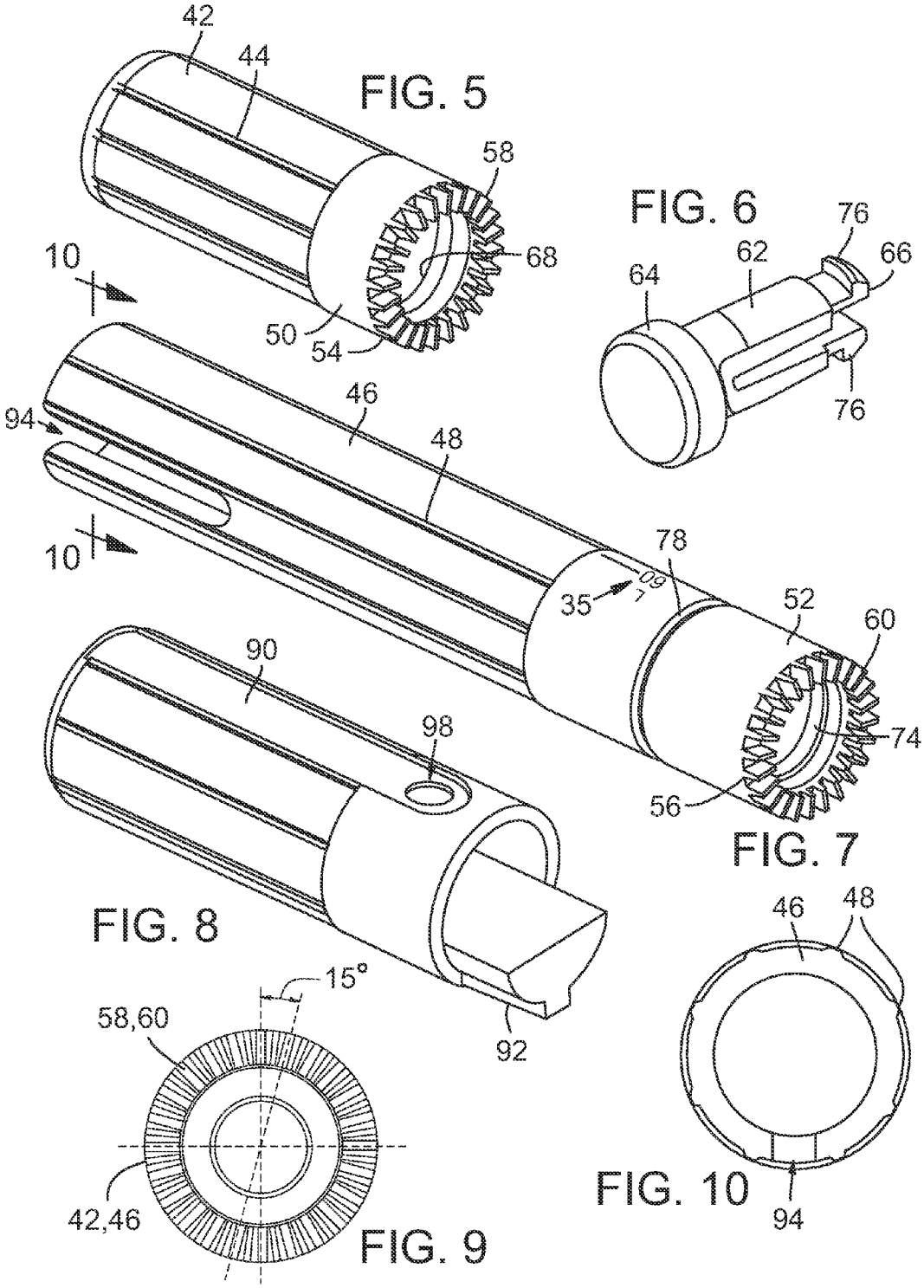
FIG. 5 is a perspective view of the spring housing.
FIG. 6 is a perspective view of the retaining clip.
FIG. 7 is a perspective view of the cylinder.
FIG. 8 is a perspective view of the receptacle.
FIG. 9 is an end view of either of the spring housing or cylinder, showing one of the toothed crowns.
FIG. 10 is an end view of the cylinder, showing a slot to receive a rail of the receptacle.
Figure 12A:
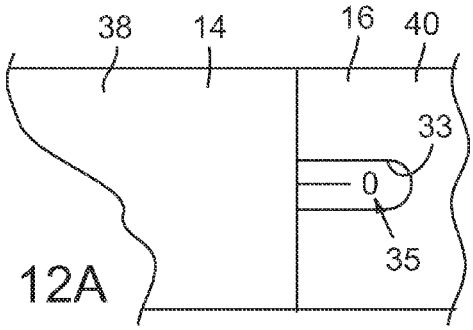
FIG. 12A is a side view of the shaft halves with an angulation reading window depicting the blades in alignment or at 0 degrees with respect to each other.

The user may switch interlocking coupling 36 from the use configuration to the selection configuration, for example, by pulling shaft halves 14, 16 apart as shown at S1 in FIG. 2, overcoming the bias of spring 34. Such movement of shaft halves 14, 16 moves ends 50, 52 of housing 42 and cylinder 46 apart, as shown at S2 in FIG. 2, typically by the same distance. This movement, also shown at S in FIG. 4*b*, disengages teeth 58, 60 and allows a relative rotation of shaft halves 14, 16 about longitudinal axis L to change offset angle A. When the user allows biasing member 34 to re-engage teeth 58, 60, the paddle is set at the newly selected offset angle A. As shown in FIG. 9, teeth 58, 60 may be spaced apart at 15-degree intervals and alternatively may be spaced at any other suitable intervals.

Figure 13:
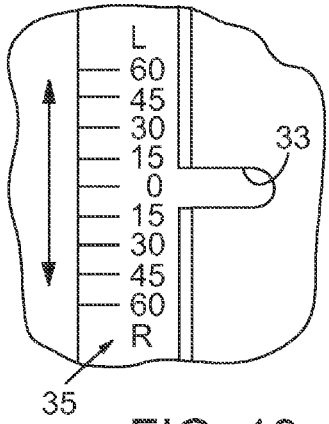
FIG. 13 is a view corresponding to FIGS. 12A-D except that the shafts have been schematically flattened out to show the entire range of possible angulation of the blades.
Figure 12B:
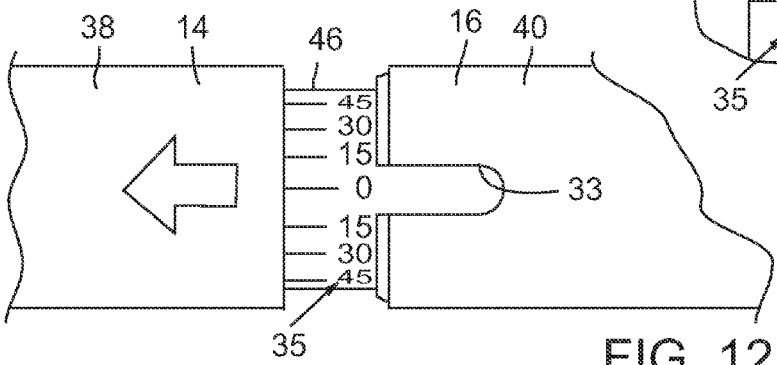
FIG. 12B corresponds to FIG. 12A except that the shaft halves have been pulled apart against the spring bias to permit the user to change the relative angulation of the blades.
Figure 12C:
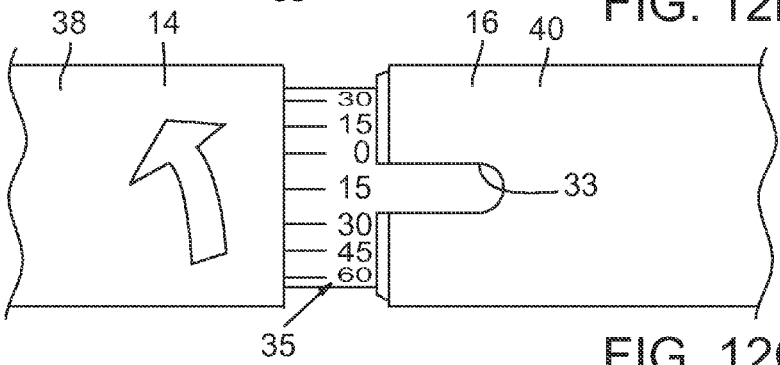
FIG. 12C corresponds to FIGS. 12A and 12B except that the shaft halves have now been rotated by 15 degrees.
Figure 12D:
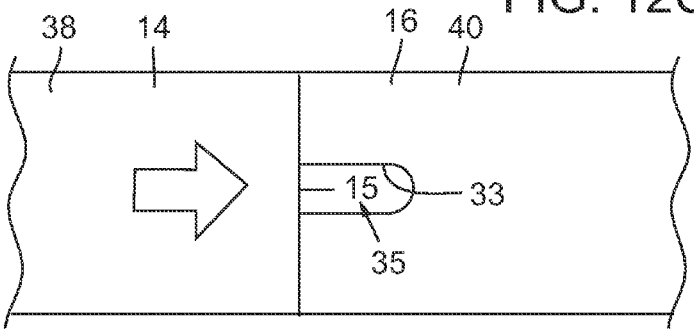
FIG. 12D corresponds to FIGS. 12 A-C except that the shaft halves have been released so that the spring biasing brings the halves together, with the window showing the new 15 degree angulation of the blades with respect to each other.

FIGS. 12A-D and 13 best depict a system for reading the angulation between blades 20 and 24 that may be included. Prior to adjusting the angulation of the blades, window 33 permits the user to see that the blades are in alignment with each other, or at 0 degrees (see FIG. 12A). When shaft halves 14, 16 are pulled apart, as shown in FIG. 12B, another angulation may be selected as the shaft halves are rotated with respect to each other, as shown in FIG. 12C. When shaft halves 14, 16 are released as shown in FIG. 12D, window 33 permits the user to see the blade angulation that has been selected. It will be understood that the schematic view in FIG. 13 shows the entire range of angulation that may be selected. Here it is shown to be 60 degrees in either direction although in certain applications, greater or lesser angulation may be appropriate.

A retaining clip 62 may be coupled between first and second shaft halves 14, 16, both to provide a mount for spring 34 and to prevent disassembly of the shaft halves. Preferably, retaining clip 62 prevents disassembly of the first and second shaft halves with the interlocking coupling both in the use configuration and in the selection configuration. Retaining clip 62 typically includes a base 64 and a head 66.

Spring housing 42 may be provided with a first shoulder 68. Spring 34 may be installed within spring housing 42 with a first end 70 abutting first shoulder 68 and a second end 72 abutting base 64 of retaining clip 62.

Cylinder 46 may include a second shoulder 74 that receives and holds head 66 of retaining clip 62. For example, head 66 of retaining clip 62 may include a pair of hooks 76 that connect to second shoulder 74. Hooks 76 may be compressible toward one another for insertion of head 66 of retaining clip 62 into the second shaft half at cylinder 46.

With retaining clip 62 mounted within the shaft with base 64 held in the first shaft half and head 66 held in the second shaft half, disassembly of the shaft halves, at least at interlocking coupling 36, is prevented. Spring 34 allows partial separation of the shaft halves to the extent necessary to select an offset angle A for blades 20, 24.

Typically the first and second mating surfaces of the shaft halves are biased into contact with one another in the use configuration, and a gap is introduced between them for the selection configuration. An o-ring 78 may be mounted within the shaft halves, for example on cylinder 46, to prevent water and other foreign matter from passing from the gap between the shaft halves into the interior of the shaft. Preferably, one of the shaft halves slides along o-ring 78 while moving into and out of the selection configuration. O-ring 78 is typically mounted between the mating surfaces of the shaft halves and the mating teeth of the interlocking coupling, thereby protecting the teeth and the spring from foreign matter.

A disassembly control 80 is typically mounted to the shaft so that the shaft halves may be disassembled from one another even though such disassembly does not occur at retaining clip 62. Disassembly control 80 is preferably operable to remove at least one of the spring housing and the cylinder from the shaft halves, and is illustrated allowing removal of cylinder 46, as best seen in FIG. 11.

Disassembly control 80 may include a pushbutton 82 that extends through a hole 84 in shaft 12 that the user operates by depressing to disassemble the shaft halves. Pushbutton 82 typically is fabricated of a resilient material with an enlarged head that provides a seal to minimize the amount of water that can access the internal portions of the paddle through hole 84. Pushbutton 82 is coupled to a lever or other control, such as snap button 86 that includes a beveled knob 88. Snap button 86 is typically installed in a receptacle 90 that is fixedly mounted within one of the shaft halves, preferably shaft half 16. Receptacle 90 also includes a hole 98 (see FIGS. 3 and 8) that corresponds in the assembled configuration with hole 84 in shaft 12 and through which passes pushbutton 82.

Receptacle 90 provides a mount for the snap button, and also may include a rail 92 that fits into a slot 94 on cylinder 46. Installation of rail 92 into slot 94 generally discourages rotation of cylinder 46 about longitudinal axis L. Cylinder 46 may be slid into place and secured by beveled knob 88, at a hole 96 in cylinder 46, against movement along longitudinal axis L relative to shaft half 16. Depressing pushbutton 82 causes a corresponding depression of beveled knob 88, decoupling cylinder 46 and allowing it to be removed from shaft half 16, overcoming as necessary any press fit of cylinder 46 within shaft half 16, as shown in FIG. 11. Receptacle 90 is thus releasably coupled to cylinder 46, and may alternatively may be installed in the other shaft half and similarly coupled to housing 42. The releasable coupling to cylinder 46 or housing 42 allows disassembly of the shaft halves.

The paddle shafts and blades, and the interlocking coupling, may be formed of any suitable material. For example, the shafts may be formed using polypropylene, reinforced with woven glass fibers, which may be bonded with resin, braided carbon fiber, aramid fibers, and/or a composite of E-glass or S-Glass and/or carbon fiber materials. The blades may be formed, as an example only, from polypropylene with a urethane or PVC foam core. The interlocking coupling mechanism may be formed of plastic or metal or other materials as suited to a particular application.

The disclosure set forth above encompasses multiple embodiments. These specific embodiments as disclosed and illustrated herein are not to be considered in a limiting sense as numerous variations are possible. The subject matter of the present disclosure includes all novel and non-obvious combinations and subcombinations of the various elements, features, functions and properties disclosed herein, and equivalents of them. Where the claims recite "a" or "a first" element or the equivalent thereof, it is within the scope of the present disclosure that such claims may be understood to include incorporation of one or more such elements, neither requiring nor excluding two or more such elements.

The claims in the present disclosure are directed to certain combinations and subcombinations and are believed to be novel and non-obvious. Other combinations and subcombinations of features, functions, elements and properties may be claimed through amendment of those claims or presentation of new claims in this or a related application. Such amended or new claims, whether different, broader, narrower or equal in scope to the original claims, are also regarded as included within the subject matter of the present disclosure.

What is claimed is:

1. A paddle for use in watersports, the paddle including a shaft with a mid-portion and two ends, the mid-portion defining a longitudinal axis, the paddle further including a blade at each end of the shaft, the blades defining an offset angle relative to one another, the shaft comprising:

a first shaft half extending from one end of the shaft to a first mating surface;

a second shaft half extending from the other end of the shaft to a second mating surface positioned adjacent the first mating surface, the second mating surface biased toward the first mating surface;

a joint connecting the first and second shaft halves, the joint including a biasing member operating along the longitudinal axis of the mid-portion of the shaft, the biasing member providing a bias urging the first and second shaft halves together, the joint further including an interlocking coupling between the first and second halves, the interlocking coupling maintaining, in a use configuration, the offset angle of the blades, and the interlocking coupling allowing, in a selection configuration, a change in the offset angle of the blades;

wherein the paddle further comprises a retaining clip coupled between the first and second halves, the retaining clip preventing disassembly of the first and second shaft halves;

wherein the paddle further comprises a first shoulder coupled to the second shaft half; and wherein the retaining clip includes a base and a head, the base coupled to the first shoulder and the head coupled to the second shoulder wherein the biasing member is positioned between the base of the retaining clip and the first shoulder.

2. The paddle of claim 1 wherein the biasing member holds the interlocking coupling in the use configuration.

3. The paddle of claim 2 wherein the shaft halves are operable to be moved relative to one another in opposite directions along the longitudinal axis against the bias.

4. The paddle of claim 3 wherein the interlocking coupling is switched to the selection configuration when the shaft halves are moved relative to one another in opposite directions along the longitudinal axis against the bias.

5. The paddle of claim 1 wherein all mechanisms for switching the interlocking coupling between the use configuration and the selection configuration are located within the shaft halves.

6. The paddle of claim 5 wherein moving the shaft halves relative to one another in opposite directions along the longitudinal axis against the bias operates the mechanisms within the shaft halves to switch the interlocking coupling to the selection configuration.

7. The paddle of claim 1 wherein the retaining clip prevents disassembly of the first and second shaft halves with the interlocking coupling in the selection configuration.

8. The paddle of claim 1 wherein the biasing member is positioned between the base of the retaining clip and the first shoulder.

9. The paddle of claim 1 wherein the head of the retaining clip further comprises a pair of hooks connected to the second shoulder.

10. The paddle of claim 9 wherein the pair of hooks are compressible toward one another for insertion of the head of the retaining clip into the second shaft half.

11. The paddle of claim 1 wherein the interlocking coupling between the shaft halves includes a first toothed crown coupled to the first shaft half and a second toothed crown coupled to the second shaft half, the toothed crowns mating together in the use configuration, the toothed crowns separating from one another in the selection configuration.

12. The paddle of claim 1 wherein the shaft halves each include a hollow tube, and further wherein the interlocking coupling is contained within the hollow tubes.

13. The paddle of claim 12 wherein the interlocking coupling includes a spring housing inserted within the hollow tube of the first shaft half.

14. The paddle of claim 12 wherein the interlocking coupling includes a cylinder 5 inserted within the hollow tube of the second shaft half.

15. The paddle of claim 12 further comprising a spring housing inserted within the hollow tube of the first shaft half and a cylinder inserted within the hollow tube of the second shaft half.

16. The paddle of claim 15 further comprising a retaining clip coupled between the first and second shaft halves to prevent disassembly of the shaft halves.

17. The paddle of claim 16 wherein the spring housing includes a first shoulder, and the cylinder includes a second shoulder, and further wherein the retaining clip includes a base and a head, the base coupled to the first shoulder and the head coupled to the second shoulder.

18. The paddle of claim 17 wherein the biasing member is a spring positione between the base of the retaining clip and the first shoulder.

19. The paddle of claim 17 wherein the head of the retaining clip further comprises a pair of hooks connected to the second shoulder.

20. The paddle of claim 19 wherein the pair of hooks are compressible toward one another for insertion of the head of the retaining clip into the second shaft half.

21. The paddle of claim 15 wherein the spring housing includes a first toothed crown and the cylinder includes a second toothed crown, the toothed crowns mated together in the use configuration, the toothed crowns being separated from one another in the selection configuration.

22. The paddle of claim 15 further including an o-ring mounted within the shaft halves on one of the spring housing and the cylinder.

23. The paddle of claim 15 further comprising a disassembly control mounted to the shaft, the disassembly control operable to remove at least one of the spring housing and the cylinder from the shaft halves.

24. The paddle of claim 1 further comprising an array of indicators that show the angulation of the shaft halves and the blades with respect to each other.

25. The paddle of claim 24 further comprising a window defined in the first or the second shaft halve that permits the user to read the angulation of the blades with respect to each other.

26. The paddle of claim 25 wherein the interlocking coupling is positioned at a mid-section of the paddle, and the array of indicators is positioned adjacent the interlocking coupling, so that when the user pulls the shaft halves apart to the selection configuration, the user can see at least a portion of the array of indicators.

27. A paddle for use in watersports, the paddle including a shaft with a mid-portion and two ends, the mid-portion defining a longitudinal axis, the paddle further including a blade at each end of the shaft, the blades defining an offset angle relative to one another, the shaft comprising:

a first shaft half extending from one end of the shaft to a first mating surface; a second shaft half extending from the other end of the shaft to a second mating surface positioned adjacent the first mating surface;

a joint connecting the first and second shaft halves, the joint including an interlocking coupling between the first and second halves, the interlocking coupling maintaining, in a use configuration, the offset angle of the blades, and the interlocking coupling allowing, in a selection configuration, a change in the offset angle of the blades, wherein the shaft halves are operable to be moved relative to one another in opposite directions along the longitudinal axis to switch the interlocking coupling from the use configuration to the selection configuration, and wherein all mechanisms for switching the interlocking coupling between the use configuration and the selection configuration are located within the shaft halve;

wherein the shaft halves each include a hollow tube, and further wherein the interlocking coupling is contained within the hollow tubes;

wherein the paddle further comprises a spring housing inserted within the hollow tube of the first shaft half and a cylinder inserted within the hollow tube of the second shaft half; and wherein the spring housing includes a first toothed crown and the cylinder includes a second toothed crown, the toothed crowns being mated together in the use configuration, the toothed crowns being separated from one another in the selection configuration.

28. The paddle of claim 27 further comprising a biasing member that holds the interlocking coupling in the use configuration.

29. The paddle of claim 27 further comprising a retaining clip coupled between the first and second shaft halves, the retaining clip preventing disassembly of the first and second shaft halves.

30. The paddle of claim 29 wherein the retaining clip prevents disassembly of the first and second shaft halves with the interlocking coupling in the selection configuration.

31. The paddle of claim 27 further comprising a retaining clip, and wherein the spring housing includes a first shoulder and the cylinder includes a second shoulder, and further wherein the retaining dip includes a base and a head, the base coupled to the first shoulder and the head coupled to the second shoulder.

32. The paddle of claim 27 further comprising an array of indicators that shows the angulation of the blades with respect to each other.

33. The paddle of claim 32 wherein the array of indicators is disposed adjacent the interlocking coupling, and the first and second halves define a window for viewing an indicator showing the angulation of the blades with respect to each other.

34. A paddle for use in watersports, the paddle including a shaft with a mid-portion and two ends, the mid-portion defining a longitudinal axis, the paddle further including a blade at each end of the shaft, the blades defining an offset angle relative to one another, the shaft comprising:

a first shaft half extending from one end of the shaft to a first mating surface;

a second shaft half extending from the other end of the shaft to a second mating surface positioned adjacent the first mating surface;

a joint connecting the first and second shaft halves, the joint including an interlocking coupling between the first and second halves, the interlocking coupling maintaining, in a use configuration, the offset angle of the blades, and the interlocking coupling allowing, in a selection configuration, a change in the offset angle of the blades; and a retaining clip coupled between the first and second shaft halves, the retaining clip preventing disassembly of the first and second shaft halves;

wherein the paddle further con rises a first shoulder coupled to the first shaft half and a second shoulder coupled to the second shaft half, and further wherein the retaining clip includes a base and a head, the base coupled to the first shoulder and the head coupled to the second shoulder; and wherein the head of the retaining clip further comprises a pair of hooks connected to the second shoulder.

35. The paddle of claim 34 wherein the retaining clip prevents disassembly of the first and second shaft halves with the interlocking coupling in the selection configuration.

36. The paddle of claim 34 further comprising a biasing member positioned 15 between the base of the retaining clip and the first shoulder.

37. The paddle of claim 34 wherein the pair of hooks are compressible towards one another for insertion of the head of the retaining clip into the second shaft half.

38. The paddle of claim 34 further comprising a disassembly control mounted to the shaft, the disassembly control operable to disassemble the shaft halves.

39. A paddle for use in watersports, the paddle including a shaft with a mid-portion and two ends, the mid-portion defining a longitudinal axis, the paddle further including a blade at each end of the shaft, the blades defining an offset angle relative to one another, the shaft comprising:

a first shaft half extending from one end of the shaft to a first mating surface;

a second shaft half extending from the other end of the shaft to a second mating surface positioned adjacent the first mating surface, the second mating surface biased toward the first mating surface;

a joint connecting the first and second shaft halves, the joint including an interlocking coupling between the first and second halves, the interlocking coupling maintaining, in a use configuration, the offset angle of the blades, and the interlocking coupling allowing, in a selection configuration, a change in the offset angle of the blades;

a retaining clip in the interlocking coupling interconnecting the first and second shaft halves, the retaining clip preventing disassembly of the first and second shaft halves in both of the use configuration and the selection configuration of the interlocking coupling; and a disassembly control mounted to the shaft, the disassembly control operable to disassemble the shaft halves;

wherein the paddle further comprises a retaining clip coupled between the first and second halves the retaining clip preventing disassembly of the first and second shaft halves;

wherein the paddle further comprises a first shoulder coupled to the second shaft half; and wherein the retaining clip includes a base and a head, the base coupled to the first shoulder and the head coupled to the second shoulder, wherein the biasing member is positioned between the base of the retaining clip and the first shoulder.

40. The paddle of claim 39 wherein the shaft halves each include a hollow tube, and further comprising a spring housing inserted within the hollow tube of the first shaft half and a cylinder inserted within the hollow tube of the second shaft half; and a receptacle fixedly mounted within one of the shaft halves, the receptacle releasably coupled to one of the spring housing and the cylinder.

41. The paddle of claim 40 wherein the disassembly control includes a button mounted to the shaft and depressible to disconnect the receptacle from the one of the spring housing and the cylinder to which the receptacle is coupled.

* * * * *